US009153173B2

(12) United States Patent
Chang et al.

(10) Patent No.: US 9,153,173 B2
(45) Date of Patent: Oct. 6, 2015

(54) PIXEL STRUCTURE AND DRIVING METHOD THEREOF

(71) Applicant: AU Optronics Corporation, Hsin-Chu (TW)

(72) Inventors: Hua-Gang Chang, Hsin-Chu (TW); Yi-Cian Chen, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 14/450,791

(22) Filed: Aug. 4, 2014

(65) Prior Publication Data

US 2015/0130779 A1 May 14, 2015

(30) Foreign Application Priority Data

Nov. 12, 2013 (TW) ..... 102141114 A

(51) Int. Cl.
*G09G 3/32* (2006.01)

(52) U.S. Cl.
CPC ..... *G09G 3/3233* (2013.01); *G09G 3/3291* (2013.01); *G09G 2300/0819* (2013.01); *G09G 2300/0852* (2013.01); *G09G 2300/0861* (2013.01); *G09G 2320/043* (2013.01); *G09G 2330/028* (2013.01)

(58) Field of Classification Search
None
See application file for complete search history.

(56) References Cited

U.S. PATENT DOCUMENTS

| | | | | |
|---|---|---|---|---|
| 2006/0221662 | A1* | 10/2006 | Park et al. | 365/145 |
| 2007/0024540 | A1* | 2/2007 | Ryu et al. | 345/76 |
| 2008/0224965 | A1* | 9/2008 | Kim | 345/76 |
| 2009/0225013 | A1* | 9/2009 | Lee et al. | 345/80 |
| 2011/0090200 | A1 | 4/2011 | Choi et al. | |
| 2011/0157125 | A1 | 6/2011 | Choi et al. | |
| 2012/0038617 | A1 | 2/2012 | Chung et al. | |
| 2012/0098810 | A1* | 4/2012 | Nieh et al. | 345/211 |
| 2014/0035799 | A1* | 2/2014 | Bae et al. | 345/82 |
| 2014/0225878 | A1* | 8/2014 | Shih et al. | 345/205 |
| 2014/0333677 | A1* | 11/2014 | Kim | 345/690 |

* cited by examiner

*Primary Examiner* — Kent Chang
*Assistant Examiner* — Benjamin Morales Fernande
(74) *Attorney, Agent, or Firm* — WPAT, PC; Justin King

(57) ABSTRACT

A pixel structure and a driving method thereof are disclosed. The driving method includes following steps. During a first displaying frame period, a threshold voltage of a transistor for driving a light-emitting diode is stored in a first capacitor, and a first data voltage is stored in a second capacitor. The threshold voltage stored in the first capacitor is utilized for compensation during the first displaying frame period. During a second displaying frame period, a second data voltage is stored in the second capacitor, and the threshold voltage stored in the first capacitor during the first frame displaying period is still utilized for compensation during the second displaying frame period.

13 Claims, 9 Drawing Sheets

PIXEL STRUCTURE AND DRIVING METHOD THEREOF

RELATED APPLICATIONS

This application claims priority to Taiwan Application Serial Number 102141114, filed Nov. 12, 2013, which is herein incorporated by reference.

BACKGROUND

1. Field of Invention

The embodiments of present invention relate to a pixel structure. More particularly, the embodiment relate to a pixel structure and the driving method thereof in a light emitting diode display panel.

2. Description of Related Art

With the development of the display technology in recent years, the flat-panel display is widely utilized in daily life. Because active matrix OLED (AMOLED) possesses the characteristics of high quality, high contrast, rapid response, it becomes popular for consumers.

For a conventional AMOLED, each of the pixels includes two transistors (writing transistor and driving transistor), a pixel capacitor and an organic light emitting diode. When the writing transistor of the pixel structure is conducted by the scanning signal, the data signal is read and temporally stored in the pixel capacitor. At this moment, the driving current of the light emitting diode from the driving transistor may be calculated by the formula as below:

$$I = \frac{1}{2}\beta(Vgs - Vth)^2$$

In the formula above, I represents the driving current; β represents a constant number; $V_{gs}$ represents the differential potential of the source/drain electrode in the driving transistor; and $V_{th}$ represents the threshold voltage of the driving transistor.

Owing to the manufacturing variation of different pixels, the transistors thereof may have different threshold voltages. Accordingly, the driving currents of different pixels may be varied so that the brightness of the organic light emitting diode is not uniform.

Besides, after an operation period of the organic light emitting diode, the electrical characteristics of the OLED may be changed easily. With different emitting status for every pixels on the panel (for example, high brightness, low brightness, long emitting period, alternative emitting and so on), the decay level of OLED's characteristics is not uniform so that it may result in non-uniform brightness.

Furthermore, with the size of the panel enlarging, it needs longer signal wires to transmit power signal (for example, system voltage OVDD) to the pixels. The longer the signal wire is, the higher the wire resistance is. Accordingly, the current transmitted to the pixels is decreased so that it may result in non-uniform brightness.

SUMMARY

According to one aspect of this disclosure, a pixel structure is disclosed. The pixel structure includes a first capacitor, a second capacitor, a first transistor, a second transistor, a third transistor, a fourth transistor, a fifth transistor, a sixth transistor and a light emitting diode. The first terminal of the second capacitor is electrically coupled to the second terminal of the first capacitor. The first terminal of the first transistor is configured to receive a first reference voltage. The gate terminal of the first transistor is configured to receive a first control signal. The second terminal of the first transistor is electrically coupled to the first terminal of the first capacitor. The first terminal of the second transistor is configured to receive a second reference voltage. The gate terminal of the second transistor is configured to receive a second control signal. The second terminal of the second transistor is electrically coupled between the second terminal of the first capacitor and the first terminal of the second capacitor. The first terminal of the third transistor is configured to receive a first voltage source. The gate terminal of the third transistor is configured to receive a light emitting signal. The first terminal of the fourth transistor is electrically coupled to the second terminal of the third transistor. The gate terminal of the fourth transistor is electrically coupled to the first terminal of the first capacitor. The second terminal of the fourth transistor is electrically coupled to the second terminal of the second capacitor. The first terminal of the fifth transistor is electrically coupled between the second terminal of the first capacitor and the first terminal of the second capacitor. The gate terminal of the fifth transistor is configured to receive the first control signal. The second terminal of the fifth transistor is electrically coupled to the second terminal of the second capacitor. The first terminal of the sixth transistor is electrically coupled to the second terminal of the second capacitor. The gate terminal of the sixth transistor is configured to receive a scan signal. The second terminal of the sixth transistor is configured to receive a data signal. The first terminal of the light emitting diode is electrically coupled to the second terminal of the fourth transistor. The second terminal of the light emitting diode is configured to receive a second voltage source.

According to another aspect of this disclosure, another pixel structure is disclosed. The pixel structure includes a light emitting diode, a fourth transistor, a first capacitor, a second capacitor, a second transistor, a sixth transistor and a third transistor. The second terminal of the light emitting diode is configured to receive a second voltage source. The second terminal of the fourth transistor is electrically coupled to the first terminal of the light emitting diode. The current of the light emitting diode is controlled according to the voltage difference between the gate terminal and the second terminal of the fourth transistor. The first terminal of the first capacitor is electrically coupled to the gate terminal of the fourth transistor. The first capacitor is configured to store the threshold voltage of the fourth transistor. The first terminal of the second capacitor is electrically coupled to the second terminal of the first capacitor. The first terminal of the second transistor is configured to receive a second reference voltage. The gate terminal of the second transistor is configured to receive a second control signal. The second terminal of the second transistor is electrically coupled to the second terminal of the first capacitor. When the first terminal of the first capacitor is floating, the second transistor is configured to control the voltage of the second terminal of the first capacitor according to the second control signal so that the voltage is changed from the first voltage to the second voltage, and the voltage of the first terminal of the first capacitor is adjusted according to the difference between the first voltage and the second voltage. The first terminal of the sixth transistor is electrically coupled to the second terminal of the second capacitor. The gate terminal of the sixth transistor is configured to receive a scan signal. The second terminal of the sixth transistor is configured to receive a data signal. When the first terminal of the first capacitor is floating, the sixth transistor is configured to control the voltage of the second terminal of the second capacitor according to the data signal. The first terminal of the third transistor is configured to receive a first voltage source. When the first terminal of the first capacitor is floating, the third transistor is configured to conduct the current transmitting path between the first voltage source and the fourth transistor.

According to another aspect of this disclosure, a driving method of a pixel structure is disclosed. The driving method is configured to drive the mentioned pixel structure and includes the steps as below: during a second period of a first displaying frame period, storing the threshold voltage of the fourth transistor to the first capacitor; during the third period of the first displaying frame period after the second period, turning off the first transistor, conducting the second transistor and the sixth transistor through the second control signal and the scan signal. providing a first data voltage to the data signal of the first displaying frame period through the sixth transistor, and storing the difference between the second reference voltage and the first data voltage to the second capacitor; and during the fourth period of the first displaying frame period after the third period, turning off the second transistor and the sixth transistor, utilizing the sum of the difference voltages stored in the first capacitor and the second capacitor to drive the fourth transistor so that the fourth transistor generates a first driving current to the light emitting diode.

It is to be understood that both the foregoing general description and the following detailed description are by examples, and are intended to provide further explanation of the disclosure as claimed.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF THE EMBODIMENTS

Figure 1:
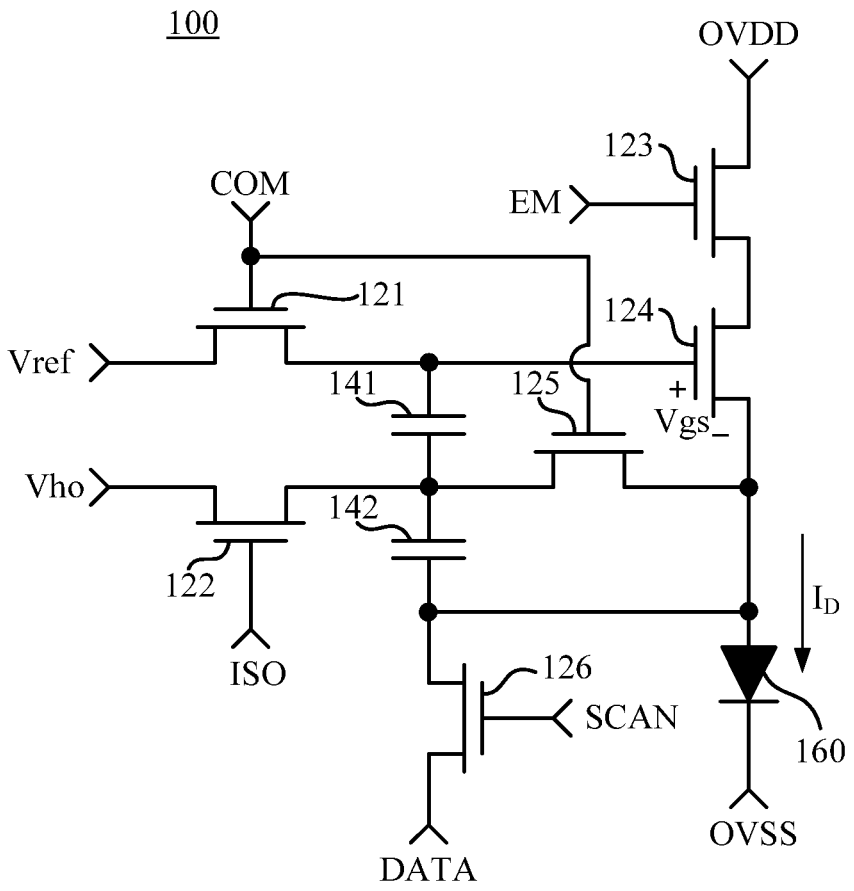
FIG. 1 is a schematic view of a pixel structure according to this disclosure.

Reference will now be made in detail to the present embodiments of the disclosure, examples of which are illustrated in the accompanying drawings. Wherever possible, the same reference numbers are used in the drawings and the description to refer to the same or like parts.

Referring to FIG. 1, FIG. 1 is a schematic view of a pixel structure 100 according to this disclosure. In practice, an active matrix organic light emitting diode (AMOLED) display panel includes plural pixel structures 100 as shown in FIG. 1. Each of the pixel structures 100 is configured to display a pixel of the screen.

As shown in FIG. 1, the pixel structure 100 includes a first transistor 121, a second transistor 122, a third transistor 123, a fourth transistor 124, a fifth transistor 125, a sixth transistor 126, a first capacitor 141, a second capacitor 142 and a light emitting diode 160. In the embodiment as FIG. 1, the pixel structure 100 includes six transistors and two capacitor (6T2C). However, this disclosure does not limit to this structure.

As shown in FIG. 1, the first terminal of the first capacitor 141 is electrically coupled to the gate terminal of the fourth transistor. The second terminal of the first capacitor 141 is electrically coupled to the second terminal of the fourth transistor 125 through the fifth transistor 125. The first terminal of the second capacitor 142 is electrically coupled to the second terminal of the first capacitor 141.

The first terminal of the first transistor 121 (one of the source/drain ends) is configured to receive the first reference voltage Vref. The gate terminal of the first transistor 121 is configured to receive the first control signal COM. The second terminal of the first transistor 121 (the other one of the source/drain ends) is electrically coupled to the first terminal of the first capacitor 141 and the gate terminal of the fourth transistor 124.

The first terminal of the second transistor 122 (one of the source/drain ends) is configured to receive the second reference voltage Vho. The gate terminal of the second transistor 122 is configured to receive the second control signal ISO. The second terminal of the second transistor 122 (the other one of the source/drain ends) is electrically coupled between the second terminal of the first capacitor 141 and the first terminal of the second capacitor 142.

The first terminal of the third transistor 123 (one of the source/drain ends) is configured to receive the first voltage source OVDD. The gate terminal of the third transistor 123 is configured to receive the light emitting signal EM. The second terminal of the third transistor 123 (the other one of the source/drain ends) is electrically coupled to the first terminal of the fourth transistor 124.

The first terminal (i.e., the drain end in this embodiment) of the fourth transistor 124 is electrically coupled to the first terminal of the first capacitor 141. The second terminal (i.e., the source end in this embodiment) of the fourth transistor 124 is electrically coupled to the second terminal of the second capacitor 142, the fifth transistor 125 and the light emitting diode 160.

The first terminal of the fifth transistor 125 (one of the source/drain ends) is electrically coupled between the second terminal of the first capacitor 141 and the first terminal of the second capacitor 142. The gate terminal of the fifth transistor 125 is configured to receive the first control signal COM. The second terminal of the fifth transistor 125 (the other one of the source/drain ends) is electrically coupled to the second terminal of the second capacitor 142.

The first terminal of the six transistor 126 (one of the source/drain ends) is electrically coupled to the second terminal of the second capacitor 142. The gate terminal of the sixth transistor 126 is configured to receive the scan signal SCAN. The second terminal of the sixth transistor 126 (the other one of the source/drain ends) is configured to receive the data signal DATA.

The first terminal of the light emitting diode 160 is electrically coupled to the source terminal of the fourth transistor 124. The second terminal of the light emitting diode 160 is configured to receive the second voltage source OVSS.

In the embodiment of FIG. 1, the fourth transistor 124 is configured to control the current $I_D$ of the light emitting diode 160 according to the voltage difference Vgs between the gate terminal and the second terminal (source end) of the fourth transistor 124. The first capacitor 141 is configured to store the threshold voltage Vth between the gate and the second terminal (source end) of the fourth transistor 124.

When the first terminal of the first capacitor 141 is floating, the second transistor 122 is configured to control the voltage of the second terminal of the first capacitor 141 according to the second control signal ISO (the second control signal is used as an isolation control signal in this embodiment) so that the voltage thereof is changed. The voltage of the first terminal of the first capacitor 141 is adjusted according to the difference of said voltage change. When the first terminal of the first capacitor is floating, the sixth transistor is configured to control the voltage of the second terminal of the second capacitor 142 according to the data signal DATA. The third transistor 123 is configured to conduct the current transmitting path between the first voltage source OVDD and the fourth transistor 124.

In the embodiment above, for example, the first voltage source OVDD is the high voltage source of the system (e.g. 5 V); the second voltage source OVSS is the low voltage source of the system (e.g. 0 V); the first reference voltage Vref and the second reference voltage Vho are the reference voltage signals for the fixed voltage level. The fixed voltage level of the first reference voltage Vref and the second reference voltage Vho is between the first voltage source OVDD and the second voltage source OVSS herein.

Besides, in said embodiment, the second control signal ISO (the isolation signal received by the gate terminal of the second transistor 122), the scan signal SCAN, the data signal DATA and the light emitting signal EM are utilized as the driving signals to control the operation model of the pixel structure 100. Each of them has a specific driving waveform respectively.

Figure 2:
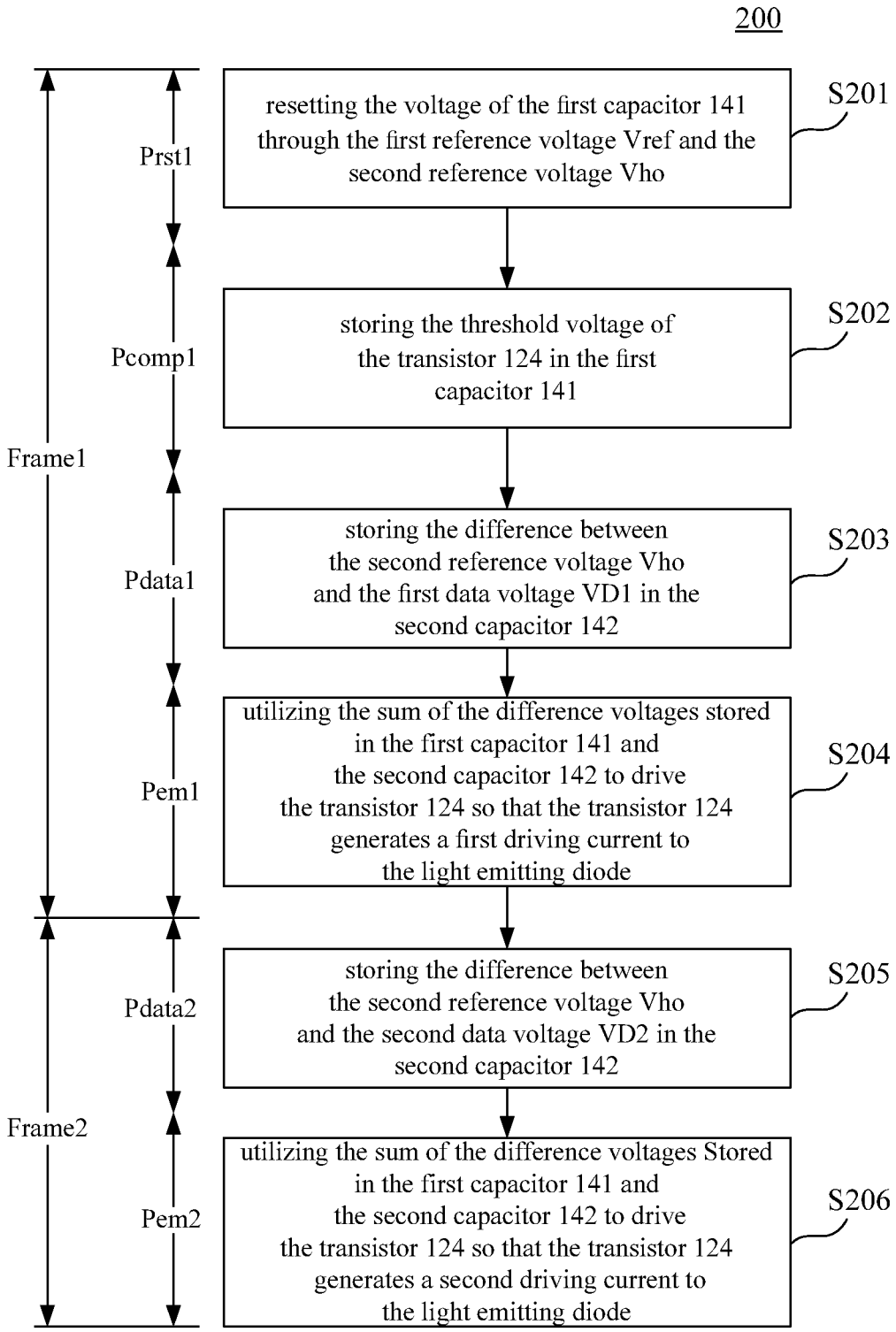
FIG. 2 is a flow chart of a driving method according to one embodiment of this disclosure.
Figure 3:
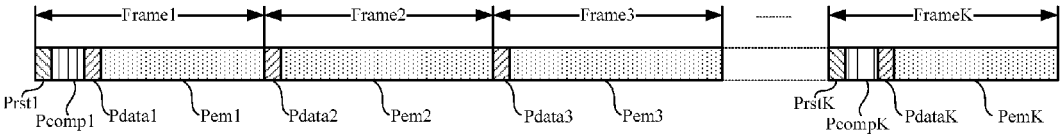
FIG. 3 is schematic time chart of the pixel structure and the driving method thereof during plural displaying frame period.
Figure 4A:
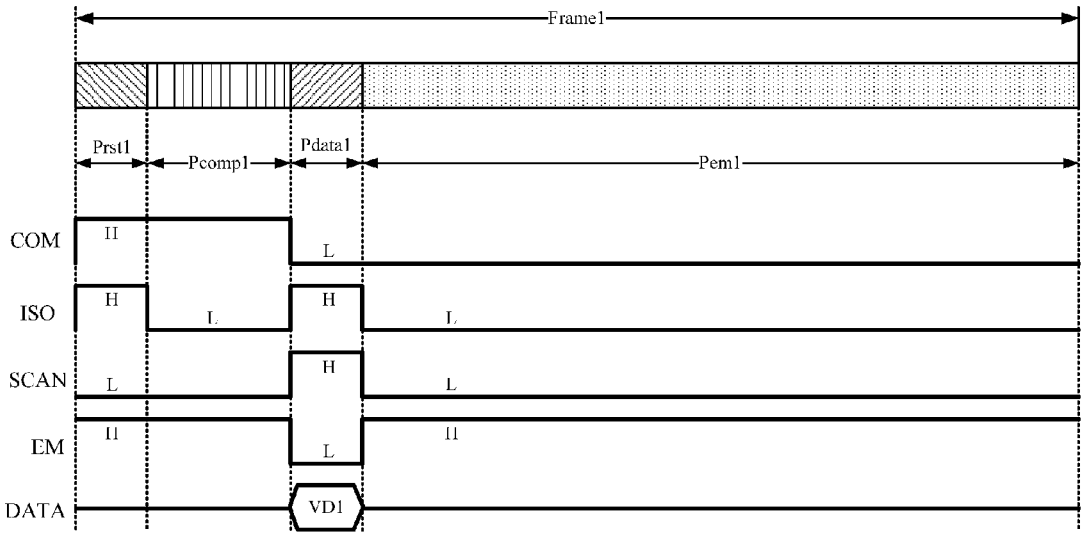
FIG. 4A is a schematic waveform graph of the related signals for the pixel structure and the driving method thereof during the first displaying frame period.
Figure 4B:
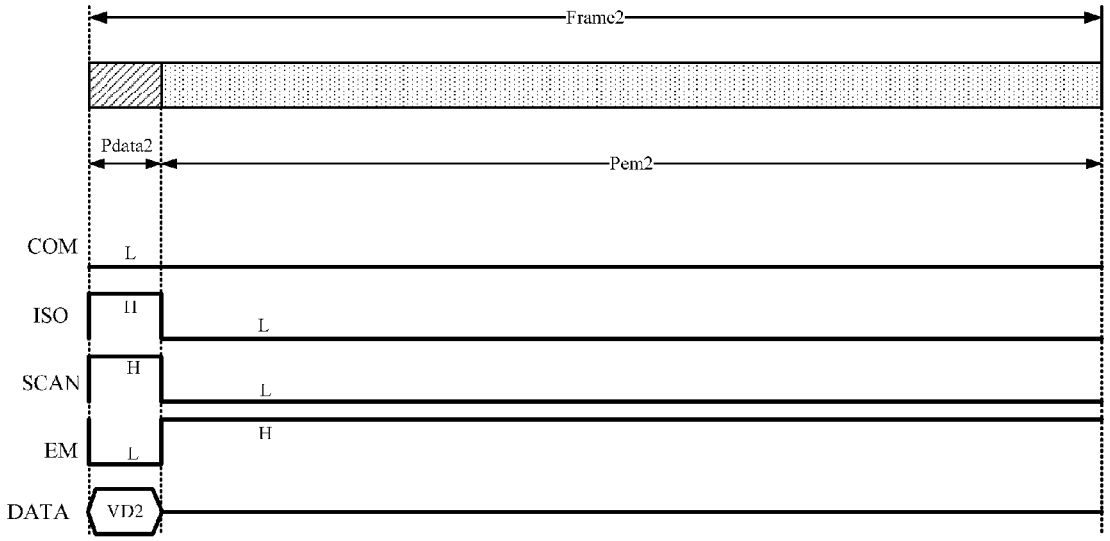
FIG. 4B is a schematic waveform graph of the related signals for the pixel structure and the driving method thereof during the second displaying frame period.

Referring to FIG. 2, FIG. 3, FIG. 4A, FIG. 4B, FIGS. 5-8, FIG. 2 is a flow chart of a driving method 200 according to one embodiment of this disclosure. The driving method 200 is configured to drive the pixel structure 100 as shown in FIG. 1. FIG. 3 is schematic time chart of the pixel structure 100 and the driving method 200 thereof during plural displaying frame period. FIG. 4A is a schematic waveform graph of the related signals for the pixel structure 100 and the driving method 200 thereof during the first displaying frame period Frame1. The waveforms of the signals include those of the second control signal ISO, the scan signal SCAN, the data signal DATA and the light emitting signal EM. FIG. 4B is a schematic waveform graph of the related signals for the pixel structure 100 and the driving method 200 thereof during the second displaying frame period Frame2. FIGS. 5 to 8 are schematic circuit operation diagrams of the pixel structure during the reset period Prst1, the compensation period Pcomp1, the data writing period Pdata1 and the light emitting period Pem1 of the first displaying frame period respectively.

The driving method 200 provides different data signals DATA to the pixel structure 100 to display different frames during different displaying frame period respectively. FIG. 3 schematically illustrates the first displaying frame period Frame1, the second displaying frame period Frame2, the third displaying frame period Frame3, . . . , and the $K^{th}$displaying frame period FrameK.

As shown in FIG. 3, FIG. 4A and FIG. 4B, the driving method 200 during the first displaying frame period Frame1 is divided to four sections for driving the pixel structure 100 as shown in FIG. 1. The first displaying frame period Frame1 includes four sections such as the reset period Prst1, the compensation period Pcomp1, the data writing period Pdata1 and the light emitting period Pem1 in sequence.

As shown in FIG. 2, the driving method 200 performs step S201 during the reset period Prst1 of the first displaying frame period Frame1. The voltages of the first terminal and the second terminal of the first capacitor 141 are reset through the first reference voltage Vref and the second reference voltage Vho.

Figure 5:
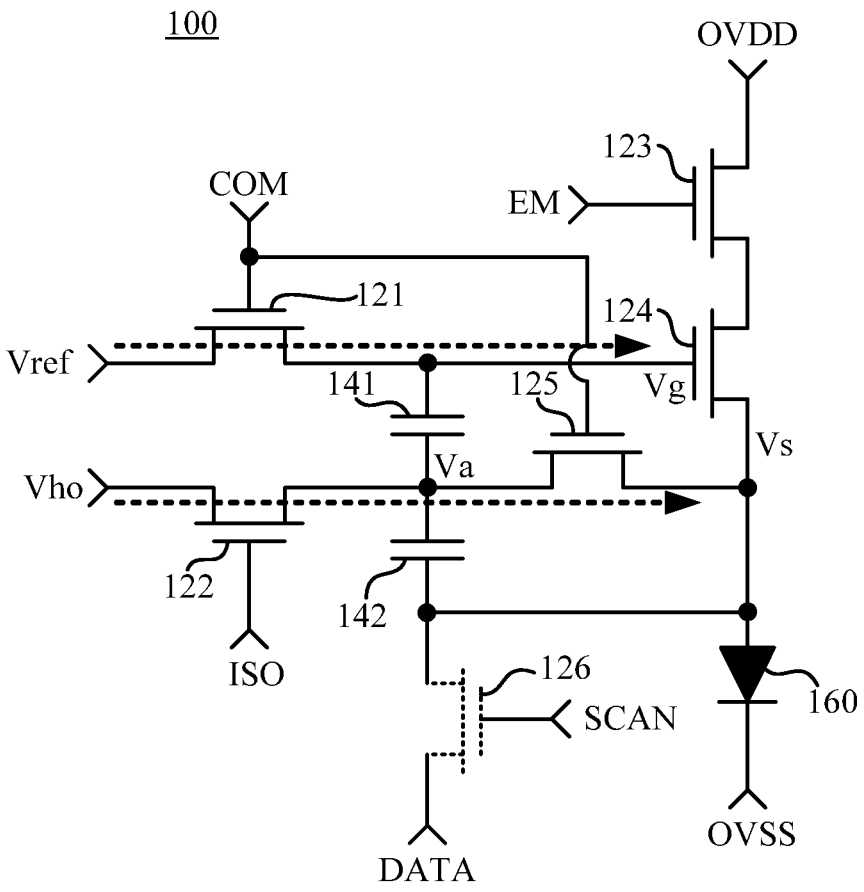
FIG. 5 is a schematic circuit operation diagram of the pixel structure during the reset period of the first displaying frame period.

Explaining step S201 in more detail, as shown in FIG. 4A and FIG. 5, during the reset period Prst1 of the first displaying frame period Frame1, the first control signal COM and the second control signal ISO are high (H). The transistors 121, 125 and 122 are conducted through the first control signal COM and the second control signal ISO. Accordingly, the first reference voltage Vref resets the voltage of the first terminal of the first capacitor 141 through the transistor 121. The second reference voltage Vho resets the voltage of the second terminal of the first capacitor 141 through the transistor 122. Meanwhile, because of the scan signal SCAN with low level, the transistor 126 is off (the dotted lines represents the off status of the transistor in FIGS. 5-8). The transistors 126 and 125 are configured to reset the second terminal of the second capacitor 142.

During the reset period Prst1, the gate voltage Vg of the transistor 124 is equal to the first reference Vref. The source voltage Vs of the transistor 124 is equal to the second reference voltage Vho. The node voltage Va between the first capacitor 141 and the second capacitor 142 is equal to the second reference voltage Vho.

As shown in FIG. 2, the driving method 200 performs step S202 during the compensation period Pcomp1 of the first displaying frame period Frame1. The threshold voltage Vth between the gate terminal and the second terminal (source end) of the transistor 124 is stored in the first capacitor 141.

Figure 6:
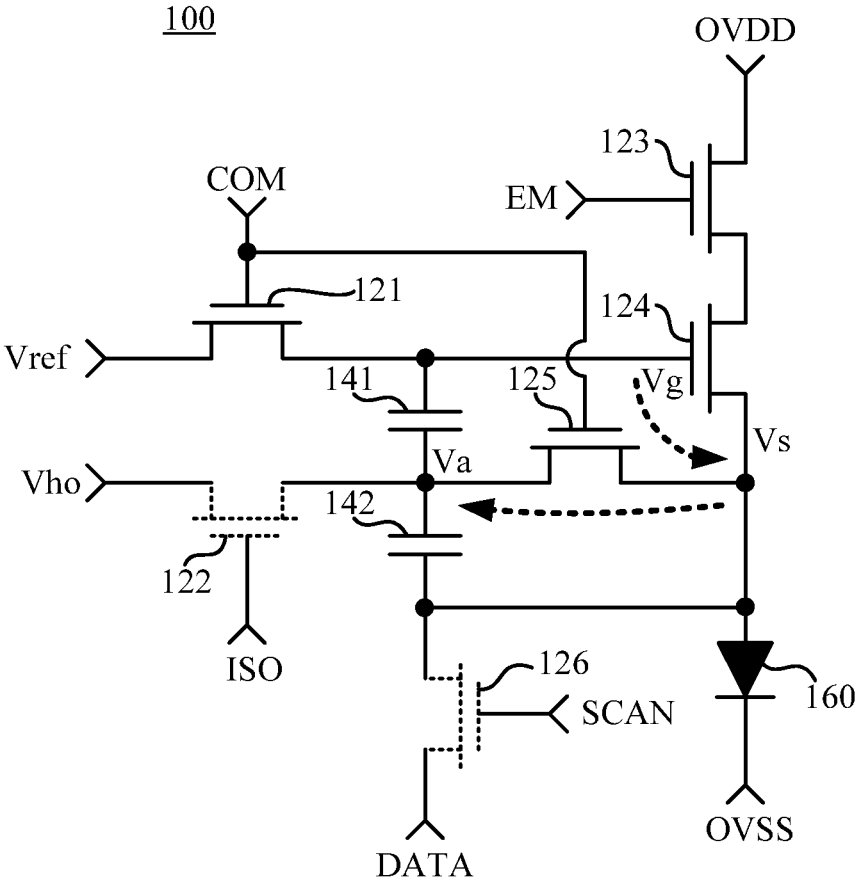
FIG. 6 is a schematic circuit operation diagram of the pixel structure during the compensation period of the first displaying frame period.

Explaining step S202 in more detail, as shown in FIG. 4A and FIG. 6, during the compensation period Pcomp1 of the first displaying frame period Frame1, the control signal COM keeps high. The second control signal ISO is switched to low and the transistor 122 is off so that the source voltage Vs and the node voltage Va are floating. The gate voltage Vg is fixed as the first reference voltage Vref. The source voltage Vs is approaching Vref−Vth gradually through discharging the transistor 124 wherein Vth represents the threshold voltage of the transistor 124 (not shown in figures). Because the voltage of the first terminal of the first capacitor 141 is fixed as Vref and the voltage of the second terminal of the first capacitor 141 is Vref−Vth, the threshold voltage between the gate terminal and the source terminal of the transistor 124 is stored between the two ends of the first capacitor 141. Then, transistors 122 and 126 are off (as dotted lines in FIG. 6).

During the compensation period Pcomp1, the gate voltage Vg of the transistor 124 is equal to Vref. The source voltage Vs of the transistor 124 is equal to "Vref−Vth". The node voltage Va between the first capacitor 141 and the second capacitor 142 is equal to "Vref−Vth" wherein Vth represents the threshold voltage of the transistor 124.

As shown in FIG. 2, the driving method 200 performs step S203 during the data writing period Pdata1 of the first displaying frame period Frame1. The difference between the second reference voltage Vho and the first data voltage VD1 is stored in the second capacitor 142.

Figure 7:
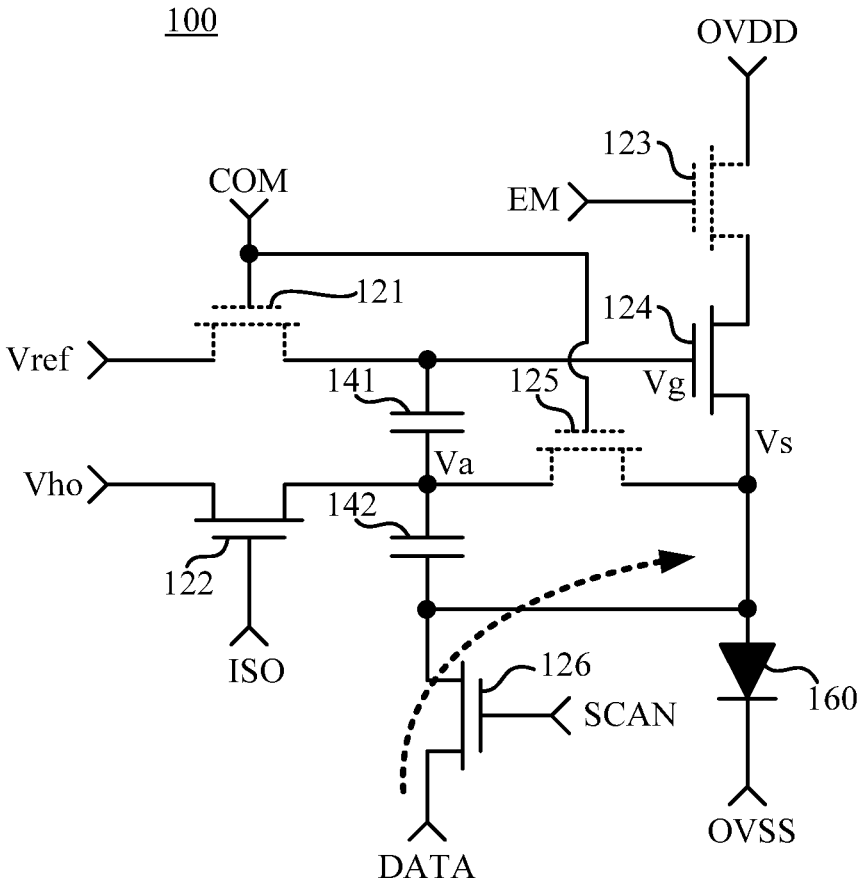
FIG. 7 is a schematic circuit operation diagram of the pixel structure during the data writing period of the first displaying frame period.

Explaining step S203 in more detail, as shown in FIG. 4A and FIG. 7, during the data writing period Pdata1 of the first displaying frame period Frame1, the first control signal COM is switched to low and the transistor 121 and 125 are off so that the gate voltage Vg is floating. The second control signal ISO is switched to high to conduct the transistor 122. Thus, the node voltage Va is changed from the first voltage (i.e. Vref−Vth) to the second voltage (i.e. the second reference voltage Vho). According to the difference between the first voltage and the second voltage, the voltage of the first terminal of the first capacitor 141 is changed through the coupling effect of the first capacitor 141. At this moment, the voltage of the first terminal of the first capacitor 141 (i.e. the gate voltage Vg) is equal to Vho+Vth. The scan signal SCAN is switched to high and the data signal DATA is transmitted to the source voltage Vs. As shown in FIG. 4A, the received data signal DATA is the first data voltage VD1 of the first displaying frame period Frame1. The light emitting signal EM is switched to low and the transistor 123 is off. Then, the transistors 121, 123, 125 are off (as the dotted lines in FIG. 7).

During the data writing period Pdata1, the gate voltage Vg of the transistor 124 is equal to Vho+Vth wherein Vth represents the threshold voltage of the transistor 124. The source voltage Vs of the transistor 124 is equal to the first data voltage VD1. The node voltage Va between the first capacitor 141 and the second capacitor 142 is equal to the second reference voltage Vho. Accordingly, the difference between the second reference voltage Vho and the first data voltage VD1 is stored between the two ends of the second capacitor 142.

As shown in FIG. 2, the driving method 200 performs step S204 during the light emitting period Pem1 of the first displaying frame period Frame1. The sum of the difference voltages stored in the first capacitor 141 and the second capacitor 142 is configured to drive the transistor 124 so that the transistor 124 generates a first driving current (the driving current $I_D$ as shown in FIG. 1) to the light emitting diode 160. The value of the first driving current is substantially determined by the first data voltage VD1.

Figure 8:
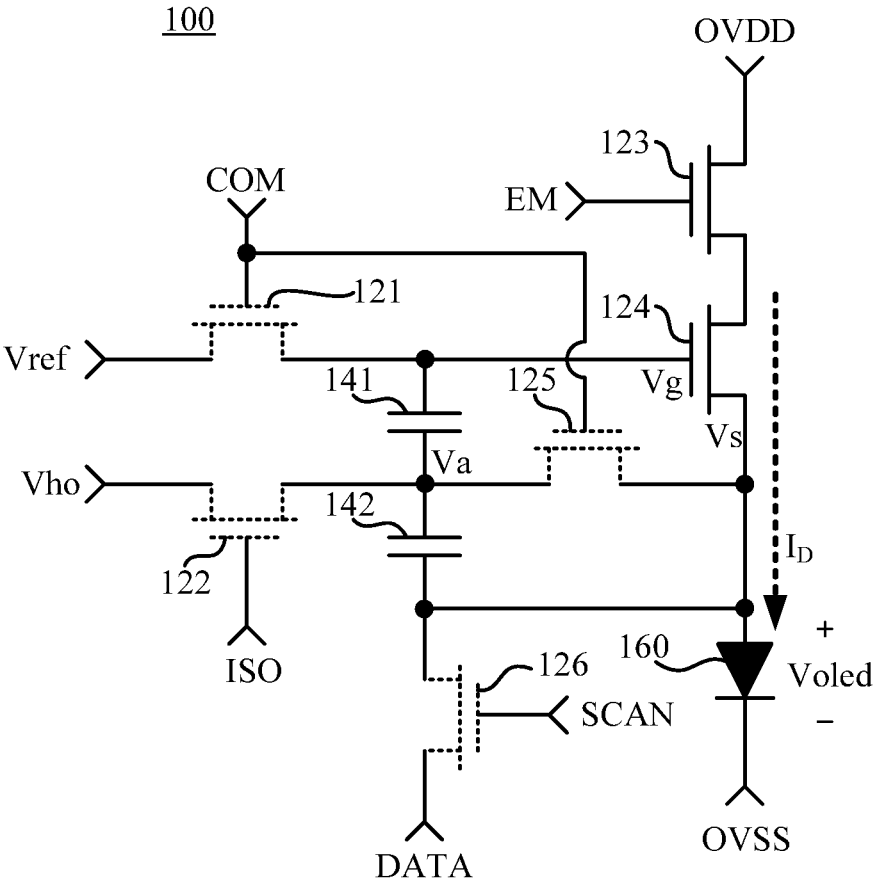
FIG. 8 is a schematic circuit operation diagram of the pixel structure during the light emitting period of the first displaying frame period.

Explaining step S204 in more detail, as shown in FIG. 4A and FIG. 8, during the light emitting period Pem1 of the first displaying frame period Frame1, the scan signal SCAN is switched to low and the transistor 126 is off. The second control signal ISO is switched to low so that the transistors 121 and 125 are off. Then, the sum of the difference voltages stored in the first capacitor 141 and the second capacitor 142 is configured to drive the gate terminal of the transistor 124 so that the transistor 124 generates a first driving current (the driving current $I_D$ as shown in FIG. 1) to the light emitting diode 160. At this moment, the transistors 121, 122, 125 and 126 are off (as the dotted lines in FIG. 8).

During the light emitting period Pem1, the source voltage Vs of the transistor 124 is equal to OVSS+Voled, wherein Voled represents the voltage between the two ends of the light emitting diode 160 during operation. The node voltage Va is equal to OVSS+Voled+Vho−VD1. The difference (Vho−VD1) between the second reference voltage Vho and the first data voltage VD1 is stored between the two ends of the second capacitor 142. The gate voltage Vg of the transistor 124 is OVSS+Voled+Vho−VD1+Vth, wherein Vth is stored between the two ends of the first capacitor 141.

Accordingly, the voltage difference Vgs between the gate terminal and the source terminal is equal to or sustainably equal to Vho−VD1+Vth. Therefore, the driving current $I_D$ generated by the transistor 124 and making the light emitting diode 160 to emit light may be calculated from the formula as below:

$$I_D = \frac{1}{2}\beta(Vgs - Vth)^2 = \frac{1}{2}\beta(Vho - VD1)^2$$

β is a constant number. Vgs is the voltage difference between the gate terminal and the source terminal of the transistor 124. Vth is the threshold voltage of the transistor 124.

That is, during the light emitting period Pem1, the driving current $I_D$ is only related to the fixed second reference voltage Vho and the first data voltage VD1, and is independent of the threshold voltage Vth of the transistor 124. Accordingly, the variation effect of the threshold voltage Vth from the process is compensated.

As shown in FIG. 2, the second displaying frame period Frame2 of the driving method 200 includes the data writing period Pdata2 and the light emitting period Pem2. In other words, the second displaying frame period Frame2 is composed of the data writing period Pdata2 and the light emitting period Pem2. During the data writing period Pdata2 of the second displaying frame period Frame2, the driving method 200 performs step S205. The difference between the second reference voltage Vho and the second data voltage VD2 is stored in the second capacitor 142.

Explaining step S205 in more detail, as shown in FIG. 4B (may refer to FIG. 7 together), during the data writing period Pdata2 of the second displaying frame period Frame2, the first control signal COM is switched to low and the transistor 121 and 125 are off so that the gate voltage Vg is floating. The second control signal ISO is switched to high to conduct the transistor 122. Thus, the node voltage Va is changed from the first voltage (i.e. OVSS+Voled+Vho−VD1) to the second voltage (i.e. the second reference voltage Vho). According to the difference between the first voltage and the second voltage, the voltage of the first terminal of the first capacitor 141 is changed through the coupling effect of the first capacitor 141. At this moment, the voltage of the first terminal of the first capacitor 141 (i.e. the gate voltage Vg) is equal to Vho+Vth. The scan signal SCAN is switched to high and the data signal DATA is transmitted to the source voltage Vs. As shown in FIG. 4B, the received data signal DATA is the second data voltage VD2 of the second displaying frame period Frame2. The light emitting signal EM is switched to low and the transistor 123 is off. Then, the transistors 121, 123, 125 are off (as the dotted lines in FIG. 7).

During the data writing period Pdata2, the gate voltage Vg of the transistor 124 is equal to Vho+Vth wherein Vth represents the threshold voltage of the transistor 124. The source voltage Vs of the transistor 124 is equal to the second data voltage VD2. The node voltage Va between the first capacitor 141 and the second capacitor 142 is equal to the second reference voltage Vho. Accordingly, the difference between the second reference voltage Vho and the second data voltage VD2 is stored between the two ends of the second capacitor 142.

As shown in FIG. 2, the driving method 200 performs step S206 during the light emitting period Pem2 of the second displaying frame period Frame2. The sum of the difference voltages stored in the first capacitor 141 and the second capacitor 142 is configured to drive the transistor 124 so that the transistor 124 generates a second driving current (the driving current $I_D$ as shown in FIG. 1 and FIG. 8) to the light emitting diode 160. Besides, during the light emitting period Pem2 of the second displaying frame period Frame2, the value of the second driving current is substantially determined by the second data voltage VD2. That is, the second driving current may be different from the first driving current. Accordingly, for different displaying frame period, the light emitting diode 160 may emit with different luminance.

Explaining step S206 in more detail, as shown in FIG. 4B (may refer to FIG. 7 together), during the light emitting period Pem2 of the second displaying frame period Frame2, the scan signal SCAN is switched to low and the transistor 126 is off. The second control signal ISO is switched to low so that the transistors 121 and 125 are off. Then, the sum of the difference voltages stored in the first capacitor 141 and the second capacitor 142 is configured to drive the gate terminal of the transistor 124 so that the transistor 124 generates a second driving current (the driving current $I_D$ as shown in FIG. 1 and FIG. 8) to the light emitting diode 160.

During the light emitting period Pem2, the source voltage Vs of the transistor 124 is equal to OVSS+Voled, wherein Voled represents the voltage between the two ends of the light emitting diode 160 during operation. The node voltage Va is equal to OVSS+Voled+Vho−VD2. The difference (Vho−VD2) between the second reference voltage Vho and the second data voltage VD2 is stored between the two ends of the second capacitor 142. The gate voltage Vg of the transistor 124 is OVSS+Voled+Vho−VD2+Vth, wherein Vth is stored between the two ends of the first capacitor 141.

Accordingly, the voltage difference Vgs between the gate terminal and the source terminal is equal to Vho−VD2+Vth. Therefore, the second driving current $I_D$ generated by the transistor 124 and making the light emitting diode 160 to emit light may be calculated from the formula as below:

$$I_D = \frac{1}{2}\beta(Vgs - Vth)^2 = \frac{1}{2}\beta(Vho - VD2)^2$$

β is a constant number. Vgs is the voltage difference between the gate terminal and the source terminal of the transistor 124. Vth is the threshold voltage of the transistor 124. That is, during the light emitting period Pem2, the second driving current $I_D$ is only related to the fixed second reference voltage Vho and the second data voltage VD2

Furthermore, as described in above embodiments, the first displaying frame period Frame1 includes four sections such as the reset period Prst1, the compensation period Pcomp1, the data writing period Pdata1 and the light emitting period Pem1. During the compensation period Pcomp1 of the first displaying frame period Frame1, the first capacitor 141 is configured to store the threshold voltage Vth of the transistor 124. During the data writing period Pdata1, the second capacitor 142 is configured to store the difference between the second reference voltage Vho and the first data voltage VD1.

In the second displaying frame period Frame2, the reset period and the compensation period are not repeated. The second displaying frame period Frame2 only includes the data writing period Pdata2 and the light emitting period Pem2. During the data writing period Pdata2, the second capacitor 142 is configured to store the difference between the second reference voltage Vho and the second data voltage VD2. During the compensation period Pcomp1, the threshold voltage Vth stored in the first capacitor 141 is shared for the first displaying frame period Frame1 and the second displaying frame period Frame2. Accordingly, the reset period and the compensation period are not necessary for the second displaying frame period Frame2. Therefore, if every displaying frame periods are the same, the light emitting period Pem2 of the second displaying frame period Frame2 may be longer than the light emitting period Pem1 of the second displaying frame period Frame1 (having the reset period Prst1 and the compensation period Pcomp1).

In plural following displaying frame periods after the second displaying frame period Frame2 (such as the third displaying frame period Frame3 shown in FIG. 2 and the like), the data voltages of the data signals for every following displaying frame periods are stored in the second capacitor 142 in sequence. Then, the fourth transistor 124 is driven so that the fourth transistor 124 generates relative driving current to the light emitting diode 160 for every following displaying frame periods respectively.

As the embodiment shown in FIG. 2, the third displaying frame period Frame3 only includes the data writing period Pdata3 and the light emitting period Pem3. During the data writing period Pdata3, the different data voltage is stored, the emitting and displaying effect may be completed accordingly. It is similar to repeating steps S205 and S206 according to different data voltage. Similarly, during the compensation period Pcomp1, the threshold voltage Vth stored in the first capacitor 141 is shared for the third displaying frame period Frame3.

Similarly, the steps S205 and S206 are repeated continuously according to different data voltages, until the threshold voltage Vth stored in the first capacitor 141 is gradually decayed and the compensation effect of the transistor 124 is decreased. Then, the displaying frame period with four periods is performed again. The steps from S201 to S204 are performed again and the threshold voltage Vth is set and stored in the first capacitor 141 again. For example, the $K^{th}$-displaying frame period FrameK includes four sections such as the reset period PrstK, the compensation period PcompK, the data writing period PdataK and the light emitting period PemK. K is a positive integer larger than three. The value of K depends on the decay rate of the threshold voltage Vth stored in the first capacitor 141. In some embodiment, the K may be nine. That is, after every eight continuous displaying frame periods, the threshold voltage Vth stored in the first capacitor 141 should be compensated. During eight continuous displaying frame periods, the compensated threshold voltage Vth is shared.

Because it is not necessary to perform resetting and compensation for the second displaying frame period Frame2, the third displaying frame period Frame 3 and so on, the emitting time may be longer. Accordingly, the pixel structure 100 and the driving method 200 thereof have better displaying luminance. Without repeating the resetting and compensation, less control signals and switching times are utilized so that the power consumption is saved.

To sum up, according to the pixel structure and the driving method thereof disclosed in this disclosure, different capacitors are configured to store the threshold voltage of the driving transistor and the data voltage. For different displaying frame periods, it is only need to update the data voltage stored in a capacitor and the threshold voltage stored once may be shared for plural displaying frame periods to perform compensation.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims and their equivalents.

What is claimed is:

1. A pixel structure, comprising:

a first capacitor, having a first terminal and a second terminal;

a second capacitor, having a first terminal and a second terminal, wherein the first terminal of the second capacitor is electrically coupled to the second terminal of the first capacitor;

a first transistor, having a first terminal to receive a first reference voltage, a gate terminal to receive a first control signal, and a second terminal electrically coupled to the first terminal of the first capacitor;

a second transistor, having a first terminal to receive a second reference voltage, a gate terminal to receive a second control signal, and a second terminal electrically coupled between the second terminal of the first capacitor and the first terminal of the second capacitor;

a third transistor, having a first terminal to receive a first voltage source, a gate terminal to receive a light emitting signal and a second terminal;

a fourth transistor, having a first terminal electrically coupled to the second terminal of the third transistor, a gate terminal electrically coupled to the first terminal of the first capacitor and a second terminal electrically coupled to the second terminal of the second capacitor;

a fifth transistor, having a first terminal electrically coupled between the second terminal of the first capacitor and the first terminal of the second capacitor, a gate terminal to receive the first control signal and a second terminal electrically coupled to the second terminal of the second capacitor;

a sixth transistor, having a first terminal electrically coupled to the second terminal of the second capacitor, a gate terminal to receive a scan signal and a second terminal to receive a data signal; and a light emitting diode, having a first terminal electrically coupled to the second terminal of the fourth transistor and a second terminal to receive a second voltage source.

2. The pixel structure of claim 1, wherein the first capacitor is configured to store a threshold voltage of the fourth transistor during a compensation period of a first displaying frame period, wherein the second capacitor is configured to store a difference between the second reference voltage and a first data voltage of the data signal during a first data writing period after the compensation period of the first displaying frame period, wherein the second capacitor is configured to store a difference between the second reference voltage and a second data voltage of the data signal during a second data writing period of a second displaying frame period, and wherein during the second data writing period, the first capacitor keeps the threshold voltage stored in the first capacitor during the compensation period.

3. A driving method, configured to drive the pixel structure of claim 1, the driving method comprising:

during a second period of a first displaying frame period, storing the threshold voltage of the fourth transistor to the first capacitor;

during a third period of the first displaying frame period after the second period, turning off the first transistor, conducting the second transistor and the sixth transistor through the second control signal and the scan signal, providing a first data voltage to the data signal of the first displaying frame period through the sixth transistor, and storing the difference between the second reference voltage and the first data voltage to the second capacitor; and during a fourth period of the first displaying frame period after the third period, turning off the second transistor and the sixth transistor, utilizing the sum of the difference voltages stored in the first capacitor and the second capacitor to drive the fourth transistor so that the fourth transistor generates a first driving current to the light emitting diode.

4. The driving method of claim 3, further comprising:

during a first period of the first displaying frame period before the second period, conducting the first transistor, the fifth transistor and the second transistor through the first control signal and the second control signal and reset the voltage between the first terminal and the second terminal of the first capacitor through the first reference voltage and the second reference voltage.

5. The driving method of claim 3, wherein during the second period, the method comprising:

turning off the second transistor, and continuously conducting the first transistor and the fifth transistor through the first control signal and the light emitting signal, so as to store the threshold voltage in the first capacitor.

6. The driving method of claim 3, further comprising:

during a fifth period of a second displaying frame period after the fourth period, turning off the first transistor, conducting the second transistor and the sixth transistor through the second control signal and the scan signal, providing a second data voltage corresponding the second data signal in the second displaying frame period through the sixth transistor, and the difference between the second reference voltage and the second data voltage stored in the second capacitor; and during a sixth period of a second displaying frame period after the fifth period, turning off the second transistor and the sixth transistor, utilizing the sum of the difference voltages stored in the first capacitor and the second capacitor to drive the fourth transistor so that the fourth transistor generates a second driving current to the light emitting diode, wherein the emitting time of the light emitting diode in the second displaying frame period is longer than the emitting time of the light emitting diode in the first displaying frame period.

7. The driving method of claim 6, further comprising:

during a plurality of following displaying frame periods after the second displaying frame period, storing the data voltages of the data signals in the second capacitor for every following displaying frame periods in sequence, driving the fourth transistor so that the fourth transistor generates relative driving current to the light emitting diode for every following displaying frame periods respectively.

8. The driving method of claim 6, further comprising:

during a $K^{th}$displaying frame period after the second displaying frame period, when the difference voltage of the first capacitor is decayed to far from the threshold voltage of the fourth transistor, storing the threshold voltage of the fourth transistor in the first capacitor again, wherein K is a positive integer larger than three.

9. The driving method of claim 6, wherein during the driving method performs the steps of the fifth period and the sixth period in the second displaying frame period, the threshold voltage stored in the first capacitor within the second period of the first displaying frame period is utilized for compensation when the third transistor is driven in the second displaying frame period.

10. The driving method of claim 9, further comprising:

during a plurality of following displaying frame periods after the second displaying frame period, storing the data voltages of the data signals in the second capacitor for every following displaying frame periods in sequence, driving the fourth transistor so that the fourth transistor generates relative driving current to the light emitting diode for every following displaying frame periods respectively.

11. The driving method of claim 9, further comprising:

during a $K^{th}$displaying frame period after the second displaying frame period, when the difference voltage of the first capacitor is decayed to far from the threshold voltage of the fourth transistor, storing the threshold voltage of the fourth transistor in the first capacitor again, wherein K is a positive integer larger than three.

12. A pixel structure, comprising:

a light emitting diode, having a first terminal and a second terminal, wherein the second terminal is configured to receive a second voltage source;

a fourth transistor, having a first terminal, a gate terminal and a second terminal, wherein the second terminal of the fourth transistor is electrically coupled to the first terminal of the light emitting diode, and wherein the current of the light emitting diode is controlled according to the voltage difference between the gate terminal and the second terminal of the fourth transistor;

a first capacitor, having a first terminal and a second terminal, wherein the first terminal of the first capacitor is electrically coupled to the gate terminal of the fourth transistor, and wherein the first capacitor is configured to store the threshold voltage of the fourth transistor;

a second capacitor, having a first terminal and a second terminal, wherein the first terminal of the second capacitor is electrically coupled to the second terminal of the first capacitor and the second terminal of the second capacitor is electrically coupled to the first terminal of the light emitting diode;

a second transistor, having a first terminal to receive a second reference voltage, a gate terminal receive a second control signal, and a second terminal electrically coupled to the second terminal of the first capacitor, wherein when the first terminal of the first capacitor is floating, the second transistor is configured to control the voltage of the second terminal of the first capacitor according to the second control signal so that the voltage is changed from a first voltage to a second voltage, and wherein the voltage of the first terminal of the first capacitor is adjusted according to the difference between the first voltage and the second voltage;

a sixth transistor, having a first terminal electrically coupled to the second terminal of the second capacitor, a gate terminal to receive a scan signal and a second terminal to receive a data signal, wherein when the first terminal of the first capacitor is floating, the sixth transistor is configured to control the voltage of the second terminal of the second capacitor according to the data signal; and a third transistor having a first terminal to receive a first voltage source, and wherein when the first terminal of the first capacitor is floating, the third transistor is configured to conduct the current transmitting path between the first voltage source and the fourth transistor.

13. The pixel structure of claim 12, further comprising:

a first transistor, having a first terminal to receive a first reference voltage, a gate terminal to receive a first control signal and a second terminal electrically coupled to the first terminal of the first capacitor; and a fifth transistor, having a first terminal electrically coupled to the second terminal of the first capacitor and a second terminal electrically coupled to the second terminal of the fourth transistor, wherein the fifth transistor is configured to make the voltage difference between the two ends of the first capacitor equal to the threshold voltage of the fourth transistor;

wherein the light emitting diode is an organic light emitting diode.

* * * * *